US008800246B2

(12) United States Patent
Gorton

(10) Patent No.: US 8,800,246 B2
(45) Date of Patent: Aug. 12, 2014

(54) TILE LEVELLING DEVICE

(71) Applicant: Michael Gorton, Aberglasslyn (AU)

(72) Inventor: Michael Gorton, Aberglasslyn (AU)

( * ) Notice: Subject to any disclaimer, the term of this patent is extended or adjusted under 35 U.S.C. 154(b) by 0 days.

(21) Appl. No.: 13/851,645

(22) Filed: Mar. 27, 2013

(65) Prior Publication Data

US 2014/0033640 A1 Feb. 6, 2014

(30) Foreign Application Priority Data

Aug. 1, 2012 (AU) ..... 2012101175

(51) Int. Cl.
*E04G 21/00* (2006.01)
*E04G 23/00* (2006.01)

(52) U.S. Cl.
USPC ..... 52/747.11; 52/749.11

(58) Field of Classification Search
USPC ..... 52/747.11, 98, 100, 125.4, 126.1, 52/127.7, 749.11, DIG. 1; 33/526, 527, 33/533, 645
See application file for complete search history.

(56) References Cited

U.S. PATENT DOCUMENTS

| | | | | |
|---|---|---|---|---|
| 7,992,354 | B2 * | 8/2011 | Doda, Jr. | 52/127.7 |
| 8,429,879 | B1 * | 4/2013 | Hoffman et al. | 52/747.11 |
| 2012/0023766 | A1 * | 2/2012 | Hillebrandt | 33/527 |

FOREIGN PATENT DOCUMENTS

WO 1992014012 A2 8/1992

* cited by examiner

*Primary Examiner* — Charles A Fox
*Assistant Examiner* — Patrick Maestri
(74) *Attorney, Agent, or Firm* — MH2 Technology Law Group, LLP

(57) ABSTRACT

A tile levelling device includes a base portion having an upper surface and an opposing lower surface, one or more recesses being formed in the upper surface. The tile levelling device also includes a stem frangibly connected to the base portion at or near a low point of said recess, the stem including a hole adapted to receive a wedge.

17 Claims, 3 Drawing Sheets

TILE LEVELLING DEVICE

FIELD OF THE INVENTION

The present invention relates to a tile levelling device. In particular, the present invention relates to a device for levelling and spacing tiles during installation. However, it will be appreciated that the device may be applied to other applications.

BACKGROUND OF THE INVENTION

When laying tiles, or other surface cladding panels, it is important that the tiles are laid evenly relative to the adjacent tiles. If the tiles are laid inconsistently, the finished job may be visually unsightly. In addition, if sufficient space is not provided between adjacent tiles, the tiles may not be able to expand or contract on account of thermal or moisture changes.

In order to lay tiles evenly, the tiler should take into account the space between adjacent tile, making sure that the spaces are consistent and of uniform thickness. Another important factor is that the upper surfaces of the tiles should be laid on the same plane as far as possible, so that the matrix of tiles has the appearance of being flat and consistent. Alternatively, in the scenario where this is not possible, for example where there is fall in the floor to accommodate drainage, then the adjacent edges should as far as possible be set to the same height to avoid a "step" occurring between adjacent tiles edges. Such steps may reduce the overall visual quality of the finished job, and may possibly create a trip hazard or restrict water flow.

Tiles are typically laid manually and spaced using small disposable plastic crosses or other such spacers. Whilst this is suitable for spacing the tiles, the issues of flatness is still of concern. Flatness is typically obtained by experience, and this can be difficult to achieve. The tiler must consider variables such as the amount of tile adhesive to use, variations between batches of tile adhesive, the flatness of the underlying floor or wall surface and inconsistencies in the underlying floor or wall surface.

Various methods of spacing and levelling tiles are available. One system utilises a base portion which is placed under two adjacent tiles during laying. The base portion is connected to a stem which extends between the two adjacent tiles. A hole is formed in the stem and the hole is located above the tile upper surfaces. A wedge is driven into the hole by force before the tile adhesive has set to pull the upper edges of the tiles into alignment. At a later period of time after the tile adhesive has set, the wedges are removed and the stem is snapped off by force using a mallet, kicking or by other such impact. The snapping occurs at a frangible region located on the stem. One significant disadvantage of this system is that after the snapping of the stem has occurred, a stump of the stem still projects into the space between the adjacent tiles. Whilst the stump is normally not visible after grouting of the joins, it can inhibit thermal expansion of the tiles due to temperature changes, resulting in damage to the tiles over time.

OBJECT OF THE INVENTION

It is an object of the present invention to substantially overcome or at least ameliorate one or more of the above disadvantages, or at least to provide a useful alternative.

SUMMARY OF THE INVENTION

In a first aspect, the present invention provides a tile levelling device comprising:

- a base portion having an upper surface and an opposing lower surface, one or more recesses being formed in the upper surface;
- a stem frangibly connected to the base portion at or near a low point of said recess, the stem including a hole adapted to receive a wedge.

The recess preferably has a generally V-shaped profile.

A proximal portion of the stem adjacent to the base portion preferably has a generally V-shaped profile which is more acute than the V-shaped profile of the recess.

The stem is preferably connected to the base portion with a frangible web.

The web preferably has a generally rectangular cross section.

An uppermost portion of the web is preferably located below the upper surface of the base portion.

An upper portion of the stem preferably includes a rounded projection adapted to provide an impact point for separating the stem from the base portion.

The upper surface of the base portion preferably includes one or more adhesive bonding channels.

The hole is preferably rectangular.

The V-shaped profile of the recess preferably defines an angle of approximately 90 degrees.

The tile levelling device is preferably integrally formed by an injection moulding process.

The stem is preferably pivotable through a range of motion in a clockwise or counter clockwise direction, the range of motion being limited by an abutment of the proximal portion of the stem with a wall of the recess.

In a second aspect, the present invention provides a method of levelling adjacent edges of two adjacent tiles, the method including the steps of:

- placing a base portion of a tile levelling device beneath the adjacent edges;
- locating the base portion such that a stem extending away from the base portion passes between a space located between the adjacent edges;
- forcing a wedge through a hole formed in the stem to clamp the two adjacent tiles between an upper surface of the base portion and a lower surface of the wedge; and
- frangibly separating the stem from the base portion such that the base portion remains completely beneath an underside of each of the two adjacent tiles.

BRIEF DESCRIPTION OF THE DRAWINGS

A preferred embodiment of the invention will now be described by way of specific example with reference to the accompanying drawings, in which.

DESCRIPTION OF THE PREFERRED EMBODIMENTS

Figure 1:
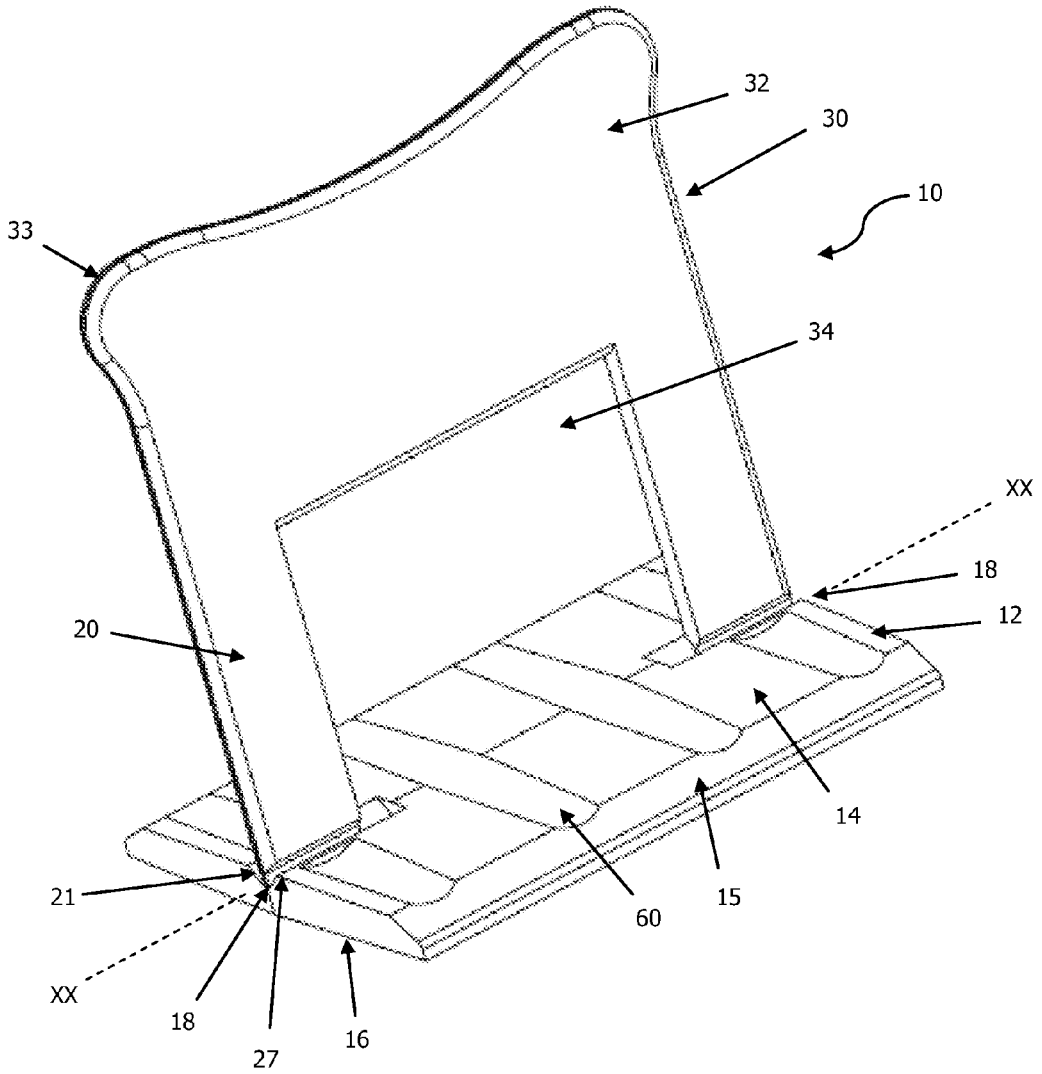
FIG. 1 is perspective view of the tile levelling device of FIG. 1.
Figure 2:
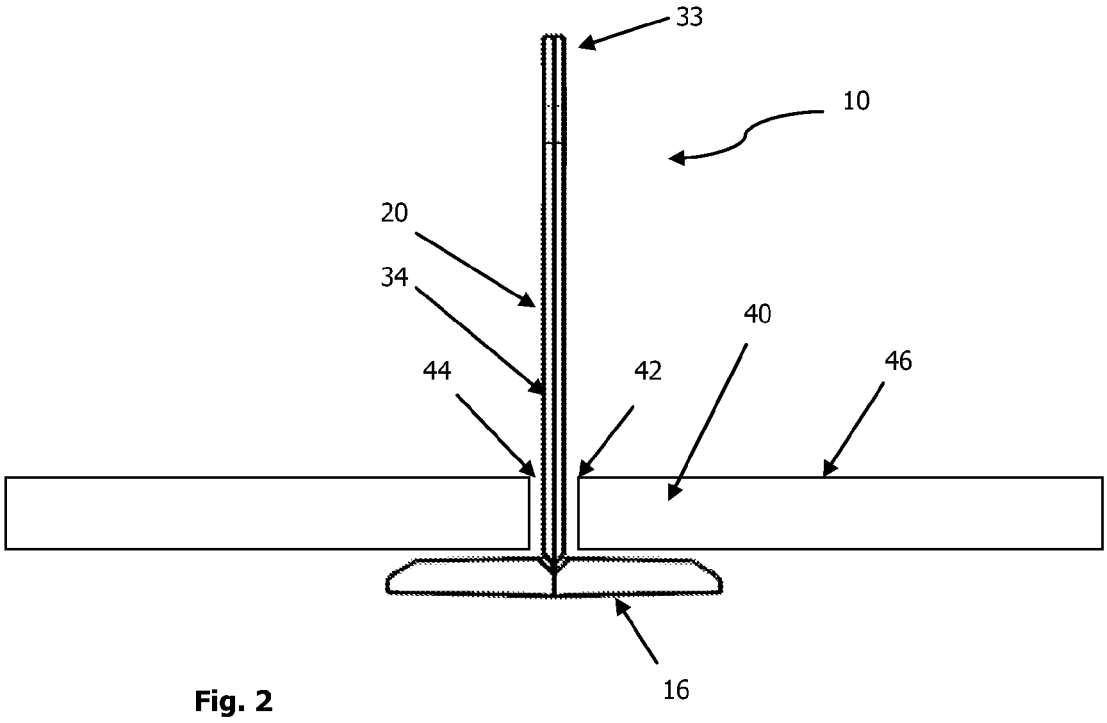
FIG. 2 is an end view of the tile levelling device of FIG. 1.

A tile levelling device 10 is disclosed in FIGS. 1 and 2. The device 10 assists in both levelling and spacing tiles 40 during laying. It will be appreciated that the device 10 can be used during the installation of other panels such as masonry panels, floor boards or other cladding panels.

As shown in FIG. 1, the tile levelling device 10 includes a generally rectangular base portion 12 having an upper surface 14 and an opposing, general flat underside surface 16. Two depressions or recesses 18 are formed in the upper surface 14. As shown in the partial detailed view of FIG. 4, the recesses 18 are generally V-shaped recesses.

The recesses 18 are located on the centre line XX of the base portion 12. Before or during the laying of tiles 40, the device 10 is located with the base portion 12 located underneath two adjacent tiles 40, such that the centre line XX extends generally along the space between the two tiles 40.

An upper portion 30 of the tile levelling device 10 includes a body 32 connected to two arms or stems 20. Proximal ends of the stems 20 are frangibly connected to the upper surface 14 of the base portion 12 at or near a low point of the recesses 18.

Figure 4:
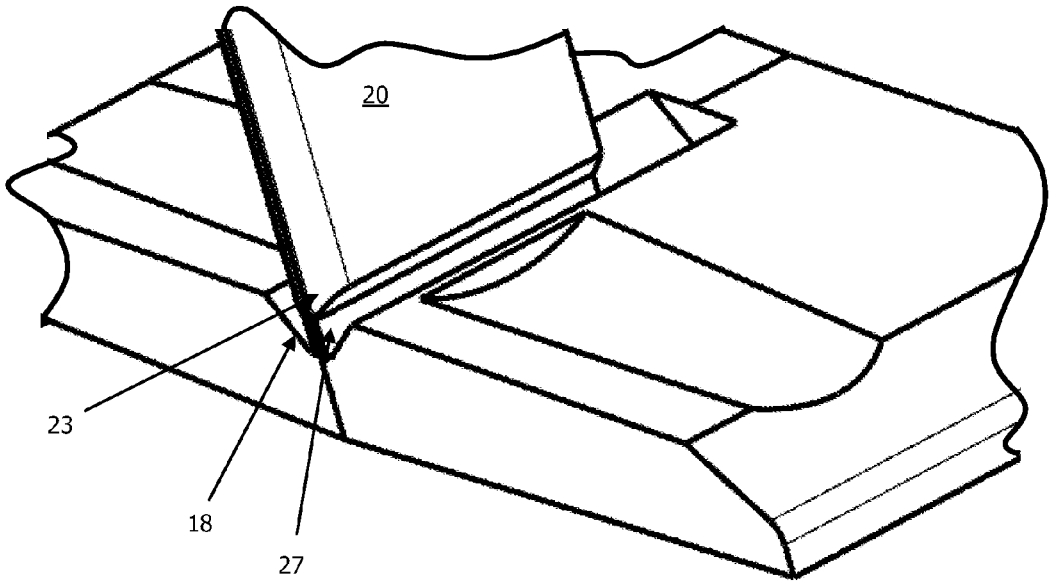
FIG. 4 is a partial perspective view of the tile levelling device of FIG. 1.

As shown in the detail of FIG. 4, the stems 20 are connected to the base of the recess 18 with thin frangible webs 27. The webs 27 are generally rectangular in cross-section. The webs 27 are located beneath a V-shaped portion 23 of the stem 20, in which the stem 20 thickness decreases to the thickness of the webs 27. The webs 27 are the thinnest portions of the upper portion 30, and as such form a breakage point between the base portion 12 and the upper portion 30.

The V-shaped portions 23 of the stems 20 extend into the generally V-shaped recesses 18, such that the upper most portions of the frangible webs 27 are located beneath the upper surface 14 of the base portion 12. However, as depicted in FIGS. 2 and 4, the webs 27 separate the stems 20 from the recesses 18.

The angle of the "V" shaped profile of the recesses 18 is approximately 90°. The angle of the "V" shaped profile the V-shaped portion 23 of the stem 20 is acute. The length of the recesses 18 is greater than the width of the stems 20 in a direction extending along axis XX.

Accordingly, the additional length of the recesses 18 provides a clearance during separation of the stems 20 from the base portion 12, as the body 32 is impacted in a direction extending generally parallel to the axis XX.

Two factors permit the upper portion 30 to be angularly titled relative to the base in either a clockwise or counter clockwise direction about the axis XX. These factors are:

1) the narrow, frangible web 27; and 2) the acute angle of the V-shaped portion 23 is less than the angle of the recesses 18.

Figure 3:
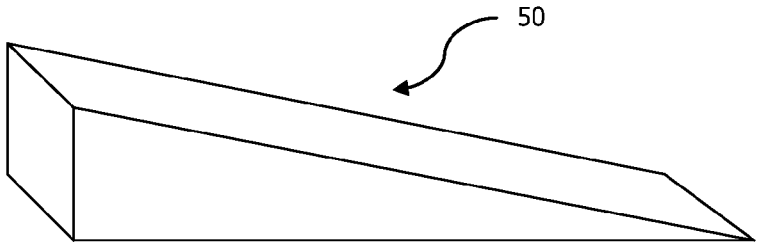
FIG. 3 depicts a wedge for use with the tile levelling device of FIG. 1.

A generally rectangular hole 34 is formed in the device 10. The hole 34 is bounded on two sides by the stems 20, bounded on one side by the body 32 and bounded on one side by the base portion 12. The hole 34 is adapted to receive a wedge 50, depicted in FIG. 3.

As depicted in FIG. 2, when two adjacent tiles 40 are located above the base portion 12, the hole 34 extends above the upper surfaces 46 of the tiles 40, permitting the wedge 50 to be driven into the hole 34. The hole 34 and wedge 50 are sized to accommodate tiles of differing thicknesses. As depicted in FIG. 2, the stems 20 project between the adjacent surfaces 42, 44 of the tiles 40. The tile levelling device 10 may be provided with stems 20 of increased dimension for thicker tiles or slabs. Alternatively, the wedge may be provided with a steeper pitch.

The upper, generally opposing corners of the body 32 include rounded projections or lugs 33 which provide an impact point for separating the stems 20 from the base portion 12. This may be by way of impact from a hammer, from kicking or another suitable tool.

The upper surface 14 of the base portion 12 includes one or more adhesive bonding channels 60 which assist to secure the base portion 12 in the desired location during laying of the tiles 40. The channels 60 extend generally perpendicular to the axis XX, and hence are perpendicular to the seam line between the adjacent tiles 40. This assists to prevent the base portion 12 from moving unintentionally when the upper portion 30 is being removed.

Bevelled edges 15 are present on the sides of the base portion 12. The bevelled edges 15 assist when pushing the base under a tile 40 into the adhesive, and directing the adhesive over the base portion 12 into the channels 60.

The tile levelling device 10 is manufactured from a polymer and is integrally formed in an injection moulding process.

The operation of the tile levelling device 10 will now be described. During tiling, the device 10 is positioned beneath two adjacent tiles 40, such that the stems 20 extend between the tiles 40, as depicted in FIG. 2. The stems assist to achieve the desired horizontal spacing (for floor applications). The channels 60 enable the tile adhesive to be located between the underside of the tiles 40 and the base portion 12. Whilst the adhesive is still uncured, the wedge 50 is driven into the hole 34.

The wedge 50 is driven by impact, using a hammer or other such implement, and the impact force causes the edges of the two adjacent tiles to be pulled into alignment, such that the adjacent tiles are clamped between the underside of the wedge 50 and the upper surface 14 of the base portion 12. Once the tiles 40 are set in the desired position, the tiles are generally left until the adhesive has cured. At this point, the wedges 50 are removed, and the upper portion 30 is removed by hitting the hugs 33 with a hammer, boot or other such implement. This causes the frangible webs 27 to break beneath the underside of the tiles 40. The spaces between the tiles 40 can then be grouted in the usual manner, and the base portion 12 remains permanently affixed under the tiles 40, where it is not visible.

Advantageously, the break point or web 27 is located below the upper surface 14 of the base portion 12 so that when the body 32 of the levelling device 10 is removed there is nothing protruding between the base plate 12 and tile seam. This is beneficial as it helps with expansion between tiles.

Advantageously, the stems 20 are able to pivot about the base of the recesses 18. This permits the body 32 to tilt as the wedge 50 is driven into the hole 34, to achieve a strong locking force to pull the adjacent tiles 40 into alignment.

Although the invention has been described with reference to specific examples, it will be appreciated by those skilled in the art that the invention may be embodied in many other forms.

The invention claimed is:

1. A tile levelling device comprising:

a base portion having an upper surface and an opposing lower surface, one or more generally V-shaped recess being formed in the upper surface;

a stem frangibly connected to the base portion at or near a low point of said one or more recess, the stem including a hole adapted to receive a wedge;

wherein a proximal portion of the stem adjacent to the base portion has a generally V-shaped profile which is more acute than the profile of the generally V-shaped recess.

2. The tile levelling device of claim 1, wherein the stem is connected to the base portion with a frangible web.

3. The tile levelling device of claim 2, wherein the frangible web has a generally rectangular cross section.

4. The tile levelling device of claim 2, wherein an uppermost portion of the frangible web is located below the upper surface of the base portion.

5. The tile levelling device of claim 3, wherein an upper portion of the stem includes a rounded projection adapted to provide an impact point for separating the stem from the base portion.

6. The tile levelling device of claim 2, wherein the upper surface of the base portion includes one or more adhesive bonding channels.

7. The levelling device claim 3, wherein the hole is generally rectangular.

8. The tile levelling device of claim 1, wherein the profile of the generally V-shaped recess defines an angle of approximately 90 degrees.

9. The tile levelling device of claim 1, wherein the device is integrally formed by an injection moulding process.

10. The tile levelling device of claim 1, wherein the one or more generally V-shaped recess comprises two generally V-shaped recesses.

11. The tile levelling device of claim 10, wherein the stem comprises two stems, and wherein each of the two stems is frangibly connected to the base portion at or near a low point of a corresponding one of the two generally V-shaped recesses.

12. The tile levelling device of claim 11, further comprising an upper portion, wherein the upper portion comprises a body and the two stems, and wherein the hole is bounded on two sides by the two stems, bounded on one side by the body, and bounded on one side by the base portion.

13. The tile levelling device of claim 10, wherein one or more channels are formed in the upper surface of the base portion and positioned between the two generally V-shaped recesses.

14. The tile levelling device of claim 13, wherein the one or more channels are substantially perpendicular to the two generally V-shaped recesses.

15. The tile levelling device of claim 10, wherein the stem is configured to be tilted relative to the base portion due to the generally V-shaped profile of the stem being more acute than the profile of the generally V-shaped recess.

16. The tile levelling device of claim 2 wherein the stem is pivotable through a range of motion in a clockwise or counter clockwise direction, the range of motion being limited by an abutment of the proximal portion of the stem with a wall of the recess.

17. A method of levelling adjacent edges of two adjacent tiles, the method including the steps of:

placing a base portion of a tile levelling device beneath the adjacent edges, wherein the base portion includes one or more generally V-shaped recess formed in an upper surface thereof;

locating the base portion such that a stem extending away from the base portion passes between a space located between the adjacent edges, wherein a proximal portion of the stem adjacent to the base portion has a generally V-shaped profile which is more acute than the profile of the generally V-shaped recess;

forcing a wedge through a hole formed in the stem to clamp the two adjacent tiles between the upper surface of the base portion and a lower surface of the wedge; and frangibly separating the stem from the base portion such that the base portion remains completely beneath an underside of each of the two adjacent tiles.

* * * * *